US007891231B2

(12) United States Patent
Song

(10) Patent No.: US 7,891,231 B2
(45) Date of Patent: Feb. 22, 2011

(54) APPARATUS FOR MONITORING AND REGISTERING THE LOCATION AND INTENSITY OF IMPACTS IN SPORTS

(76) Inventor: Jin Y. Song, 15725 Apollo Heights Ct., Saratoga, CA (US) 95070

( * ) Notice: Subject to any disclaimer, the term of this patent is extended or adjusted under 35 U.S.C. 154(b) by 72 days.

(21) Appl. No.: 12/291,249

(22) Filed: Nov. 6, 2008

(65) Prior Publication Data

US 2009/0235761 A1 Sep. 24, 2009

Related U.S. Application Data

(60) Provisional application No. 61/070,254, filed on Mar. 21, 2008.

(51) Int. Cl.
*G01M 7/00* (2006.01)

(52) U.S. Cl. ..... 73/12.09

(58) Field of Classification Search ..... 73/12.01–12.14
See application file for complete search history.

(56) References Cited

U.S. PATENT DOCUMENTS

| | | | | |
|---|---|---|---|---|
| 7,110,892 | B2 * | 9/2006 | Kim | 702/41 |
| 7,384,380 | B2 * | 6/2008 | Reinbold et al. | 482/91 |
| 7,660,692 | B2 * | 2/2010 | Van Albert et al. | 702/127 |
| 2003/0217582 | A1 * | 11/2003 | Reinbold et al. | 73/12.09 |
| 2007/0213182 | A1 * | 9/2007 | Anderson | 482/83 |
| 2008/0258921 | A1 * | 10/2008 | Woo et al. | 340/573.1 |
| 2009/0288472 | A1 * | 11/2009 | Le Carpentier | 73/12.04 |

* cited by examiner

*Primary Examiner*—Max Noori
(74) *Attorney, Agent, or Firm*—McAfee & Taft

(57) ABSTRACT

This invention relates to impact sports, and to articles of clothing and for detection systems used to monitor and registering the intensity, location and sources of impacts in contact sports such as boxing, martial arts, fencing, and so forth.

15 Claims, 6 Drawing Sheets

APPARATUS FOR MONITORING AND REGISTERING THE LOCATION AND INTENSITY OF IMPACTS IN SPORTS

This application claims the benefit of and priority under 35 U.S.C. 119e) of U.S. Provisional Patent Application No. 61/070,254 filed: Mar. 21, 2008 as incorporated herein by reference.

BACKGROUND OF THE INVENTION

This invention relates to articles of clothing worn in conjunction with various types of contact sports such as martial arts, including kick boxing, TaeKwonDo, fencing, boxing, and so forth. This invention also relates to detection systems for detecting and measuring vibrations such as weight measurement, perimeter intrusion detection, safety and security fencing, and other applications in which a force or a vibration is used to generate a detectable signal.

Prior publications forming the subject matter herein concerns the use of piezo film technical data sheets published by Measurement Specialties, Incorporated of Valley Forge, Pa. Additionally, the use of piezo film to sense impact in sporting and athletic devices is disclosed in U.S. Pat. No. 4,824,107. Also disclosed in a somewhat more limited extent is U.S. Pat. No. 5,553,880.

In combative sports such as boxing, martial arts such as kick boxing, dueling weapons such as fencing, and so forth, athletes compete in a duel. The object is to strike blows and score points while preventing an opponent from doing the same. Typically, points are awarded in these competitions to athletes who successfully deliver a legal blow to targets illustrated on designate parts or location on athletic gear such as articles of clothing. At the end of the competition, generally determined by the passage of a specific time frame, the athlete with the most points is declared the winner.

In TaeKwonDo, the athletes score points by delivering accurate "trembling" force blows to designated locations on an opponent's athletic gear through various kicking techniques. To protect athlete injuries from these blows, an athlete wears protective equipment, such as a helmet and a protective vest, on which are designated the locations on the opponent's body "legal" targets for kick-delivered impacts. Competition judges award points based on their observation of a competitor's impact delivery.

Currently, the ruling in this sport for issuance of legitimate points is the deliverance of a "trembling shock" observed by the judges as legal kicking techniques. Any other technique besides kicking is considered invalid, with the exception of a referee awarding a point to a punching technique that is deemed as good as a kick.

Although there are strict rules and regulations that govern a match, there are many shortcomings in the current scoring method, namely: 1. The observation of a "trembling shock" is qualities and subjective, and makes the definition relative and inconsistent. 2. Frequently, scoring is confusing to the players and spectators. 3. The threshold of the magnitude of an impact differs from competition to competition, which furthers the confusion of the combatants and spectators. Even within the same competition, the scoring methods differ from match to match and ring to ring, depending on interpretation of rules by the judges. 4. There is a lack of accuracy in judging due to the inability of the judges to visually keep up with the speed and position of the combatants to enable accurate and decisive observations. 5. Due to the difference in size of the combatants, the magnitude of an impact required to generate a "trembling shock" differs between age groups and weight classes, causing difficulty in judging, leading to inconsistency in scoring. 6. Judges have no way to monitor excessive force, which may cause a major injury during competition and hence the knowledge of which is useful for post-evaluation of a serious injury.

Additionally, it has been found that training for effective martial arts can be more effective with the addition of the following features:

1. Accurate measurement of the magnitude of an impact delivered by an athlete to evaluate efficiency and effectiveness of various techniques. 2. An accurate determination of the source of a technique which generated an impact. The source can be evaluated to determine the validity of the technique, while the impact determines the quality of the technique. The combination of source and impact can be used to determine a valid score. 3. During practice sparring, accurate measurement of valid techniques is important to evaluate an athlete's performance as well as to provide conditions which represent a true competitive environments. 4. Given an ability to quantitatively measure shock requirements, the athletes can monitor and optimize techniques to obtain valid points most effectively.

Accordingly, it is a principal objective of this invention to provide an article of clothing and athletic gear worn by a combatant that functions to indicate an impact delivered to a "legal" location on the body of a combatant delivered by a combatant's proper kicking technique.

Another object of this invention is to provide a detection system for recording the magnitude of the force imposed by an impact, and the legitimacy of the location at which the force is applied in relation to a combatant's body.

Another object of this invention is to provide a means and method for determining the source of the technique causing an impact. This is useful in sports requiring the distinction between a kicking technique, hand technique, elbow or other actions causing an impact.

Still another object of this invention is provide a means and method for adjustment of and setting of a threshold force that will activate equipment to account for the size and age of combatants during competition, or the appropriate threshold level during training sessions.

A further object of this invention is the provision of a means and method for indicating and recording the status of an impact on a combatant in terms of location of the impact and the intensity of force of the impact.

Another object of this invention is to provide a method and means to transmit to a control station data relating to the status of impacts delivered to a combatant for recording and display as an aid to judges when scoring legitimate points for the combatants.

Another object of this invention is to provide a method and means to facilitate the application of garments required to meet the functional objectives that are described, supra, that provide improved comfort level for the athletes wearing the equipment.

Another object of this invention is to provide a method for detecting impact and contact of weapons to weapon, and weapon to body during martial arts competition with simulated weapons. Currently, in martial arts competition or training using weapons, there are no realistic ways to determine valid techniques to keep track of a winner or loser.

THE INVENTION

Broadly speaking, the present invention is embodied in a garment or protective gear adapted to be worn by a competitor in an impact sport. The garment may be fabricated as a protective structure that incorporates sufficient padding to absorb shock impacts and embedding sensor devices in its construction to sense both impact and intensity, and to determine the source of an impact by detecting the presence of the source causing the impact.

In another aspect, the garment may be fabricated from a light woven material adapted to be worn over conventional protective gear, and the sensor devices are attached to this over-garment at suitable locations to receive the shock of impact and to indicate the location and intensity of the impact.

The sensor that detects the source of an impact is a form of proximity sensor which is triggered by the presence of a special material that a player wears on their feet or hands to distinguish it from other kinds of impact. Preferably the impact sensors are formed from piezo film or cable attached to the garment by any suitable means. The proximity sensor is triggered by a flexible magnet embedded into an attacking player's gear. When the impact sensor detects the presence of the magnet embedded in a garment or worn by an attacking player, It triggers a signal that turns on an impact sensor detection processor. The impact sensor will detect an impact only after it has been enabled by the proximity sensor, thereby generating a signal indicating the location of the impact and its intensity.

While both the impact and proximity effects occur nearly simultaneously, the magnet location is always detected moments prior to detection of impact. The multiple signals are received by a signal processing circuitry that processes the signal to determine the validity of an impact. The output of the signal processor is then transmitted or conducted to a display or user control module that indicates visually or audibly the location of an impact and intensity so that judges and/or users are aided in making an accurate decision regarding the energy of an impact and/or the issuance of legitimate points. Data from the processor may also be channeled directly into a computer or into a memory bank for later display.

Throughout the figures, the proximity sensor is implemented using conductive wires embedded in a similar pattern to the impact sensor. Regardless of the pattern, the proximity sensor is activated on detecting the approaching magnetic material which generates current or signals in the detection material that can be monitored electronically.

DESCRIPTION OF THE PREFERRED EMBODIMENTS

Figure 3:
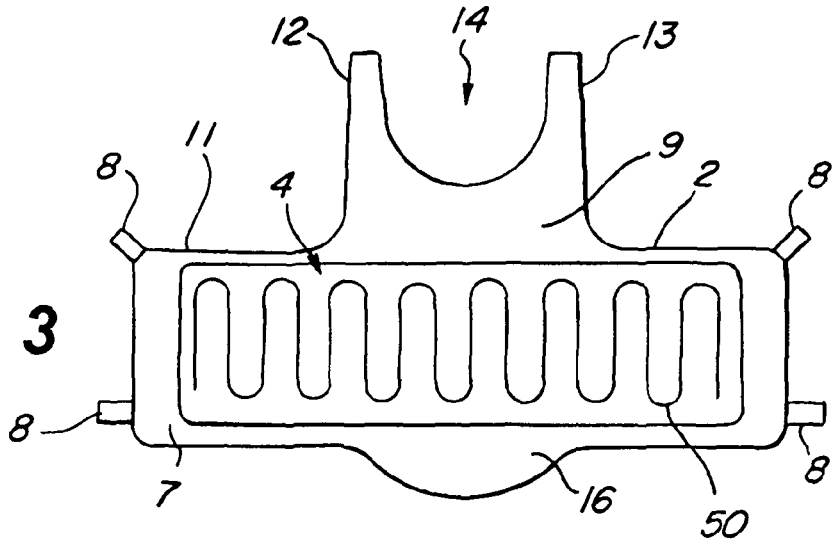
FIG. 3 is a plan view of a vest-like garment adapted to be donned over a protective gear on which is embedded a sensor in the form of a large, flat piezo electric film sensor for impact detection, and an electrically conductive wire for a proximity sensor that overlies abdominal and left and right lumbar regions of the human body.
Figure 4:
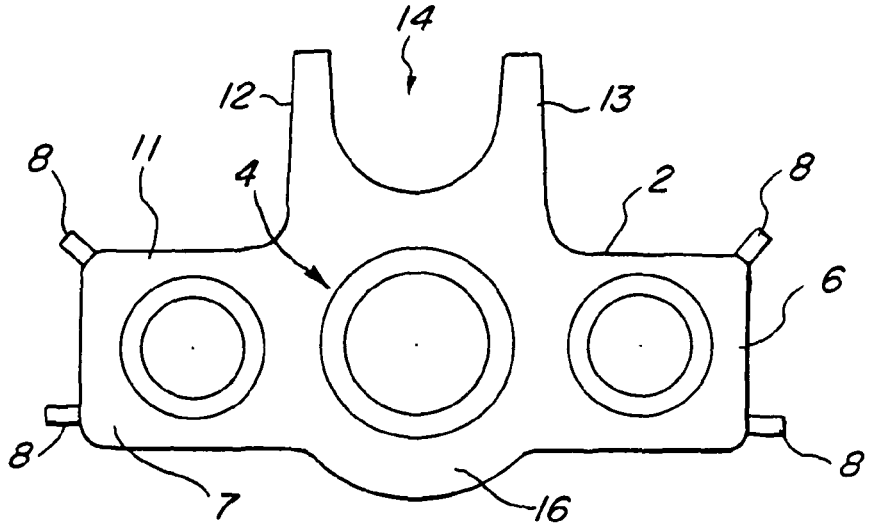
FIG. 4 is a plan view similar to FIG. 3, but illustrating an embodiment incorporating multiple flat piezo film sensors. One sensor is arranged to be positioned over the abdominal region of the human body, with separate piezo film sensors being positioned over the left and right lumbar regions of the body. The proximity sensor position is the same as in FIG. 3.
Figure 5:
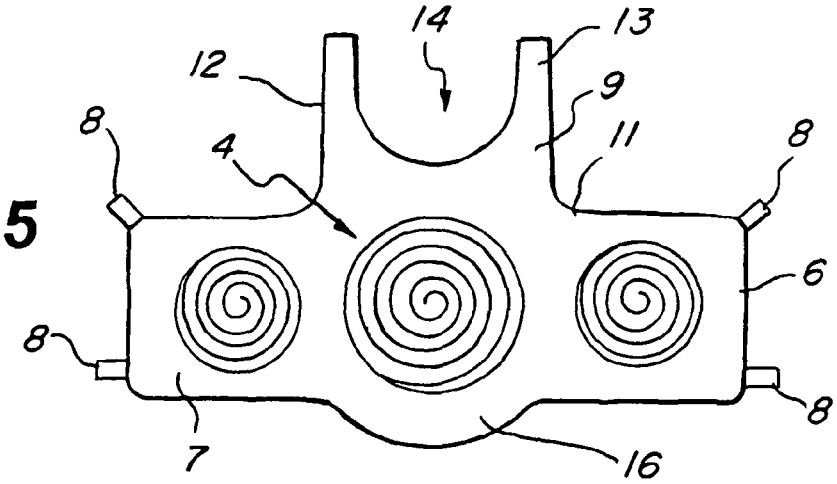
FIG. 5 is a plan view similar to FIG. 4, but illustrating yet another embodiment incorporating separate, spirally wound cable-cable type piezo film sensors in a positional arrangement similar to the arrangement in FIG. 4.
Figure 6:
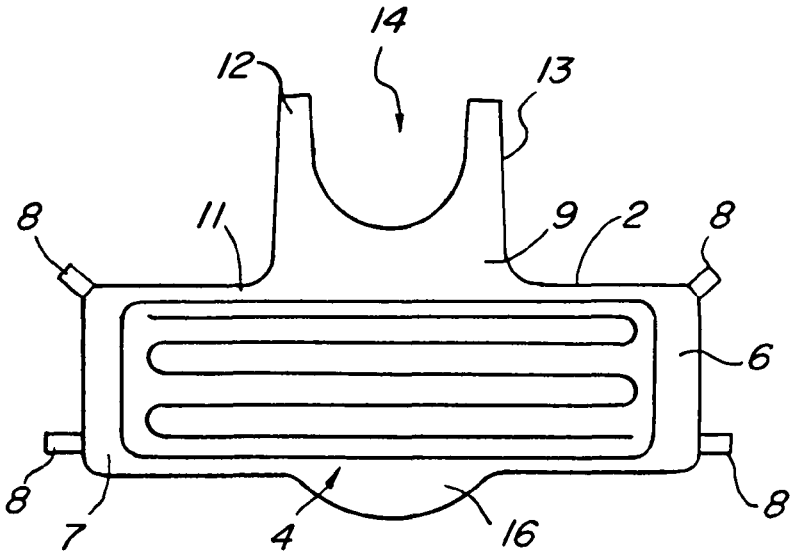
FIG. 6 is a plan view similar to FIG. 5, but illustrating yet another embodiment incorporating sensor cables distributed horizontally on the underlying vest-like garment so as to intercept impact blows over the abdominal and lumbar regions with a single elongated sensor cable.
Figure 7:
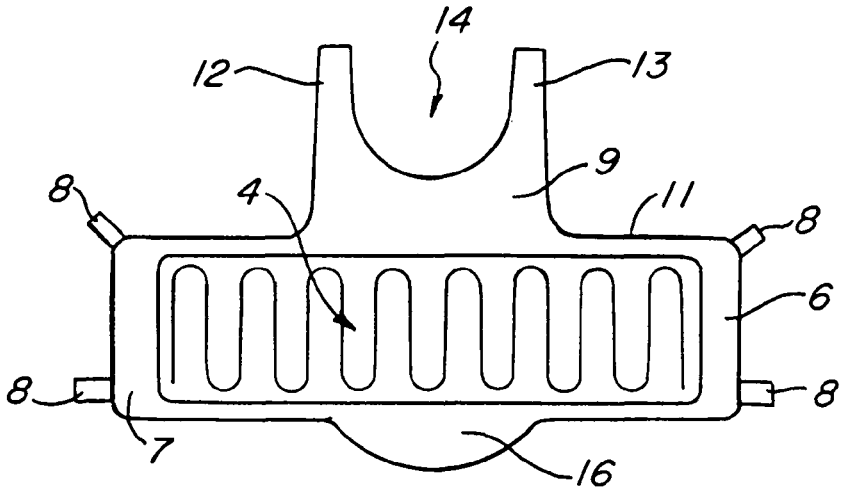
FIG. 7 is a plan view, similar to FIG. 6, but illustrating yet another embodiment utilizing a single, elongated sensor cable dispersed in a vertical pattern to intercept impact blows over the abdominal and lumbar regions of the human body when the garment is donned.
Figure 8:
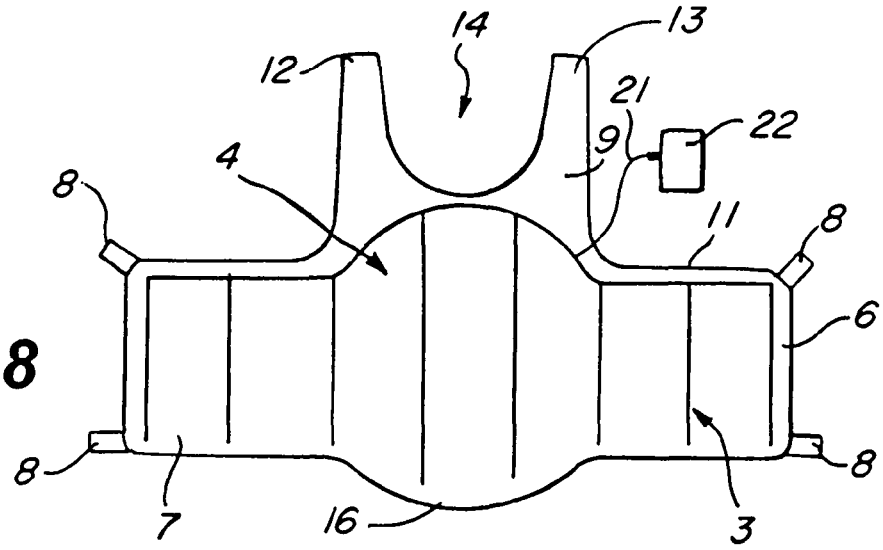
FIG. 8 is a plan view similar to FIG. 7, but illustrating yet another embodiment using a set of discrete sensor cables dispersed in a vertical pattern to intercept impact blows over the abdominal and lumbar regions of the human body when the garment is donned. The sensor cable is tied to the electronic circuit through electrically conductive wires.
Figure 9:
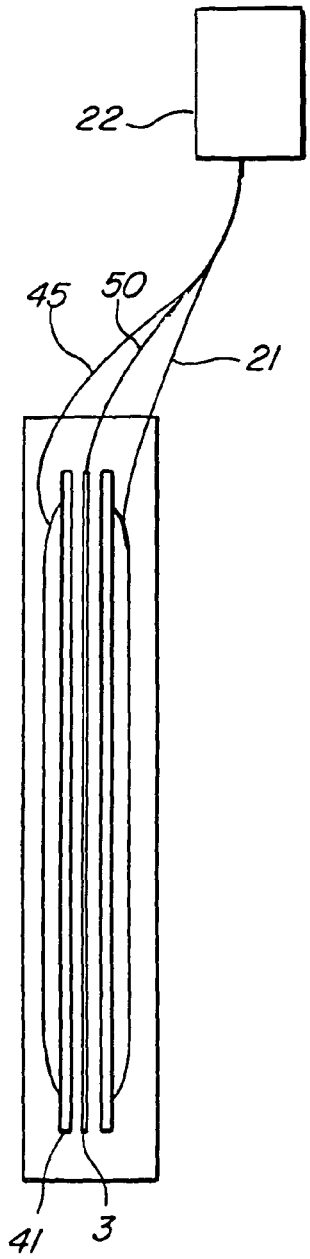
FIG. 9 is a cross-sectional view illustrating the embodiment of sensor cables being sandwiched in between two identical halves of the impact protective material. The magnetic sensing wires are mounted on both surfaces of the protective materials.

In terms of greater detail, the apparatus for monitoring and registering the location and intensity of impact sports, comprises a vest-like garment 2, equipped with the placement of appropriate force transducers or sensors 3, 44, 50 to detect impacts. An electrically conductive wire 50 as shown in FIGS. 9, 3 is placed to detect proximity.

The vest-like garment may be fabricated from an appropriate protective material, such as synthetic, resinous foam, preferably a closed-cell variety, which is capable of absorbing and distributing the kinetic energy inherent in an impact but does not absorb the perspiration that is generated during the course of competition. Alternatively, the vest-like garment may be fabricated of light wind-breaker type of material that fits and is worn over or under the protective gear of whatever design. In either case, the force-detecting transducers or sensors and the proximity sensors are attached to the garment at specific locations that constitute the target areas on the body. The transducers can also be placed in between materials that are normally used to protect the player from an impact. FIG. 9 illustrates a sandwiching of the sensor 3 between materials 40, 41.

The drawings illustrating the vest-like garment include a central body portion 4 possessing a height and width sufficient to cover the abdominal area. From the central body portion 4 of the garment there extend left and right lumbar engaging fastener tab portion members 8 attached thereto at the corners, as by stitching. Alternatively, Velcro may be used to detachably engage opposing members together to engage and hold the vest-like garment in place.

Figure 1:
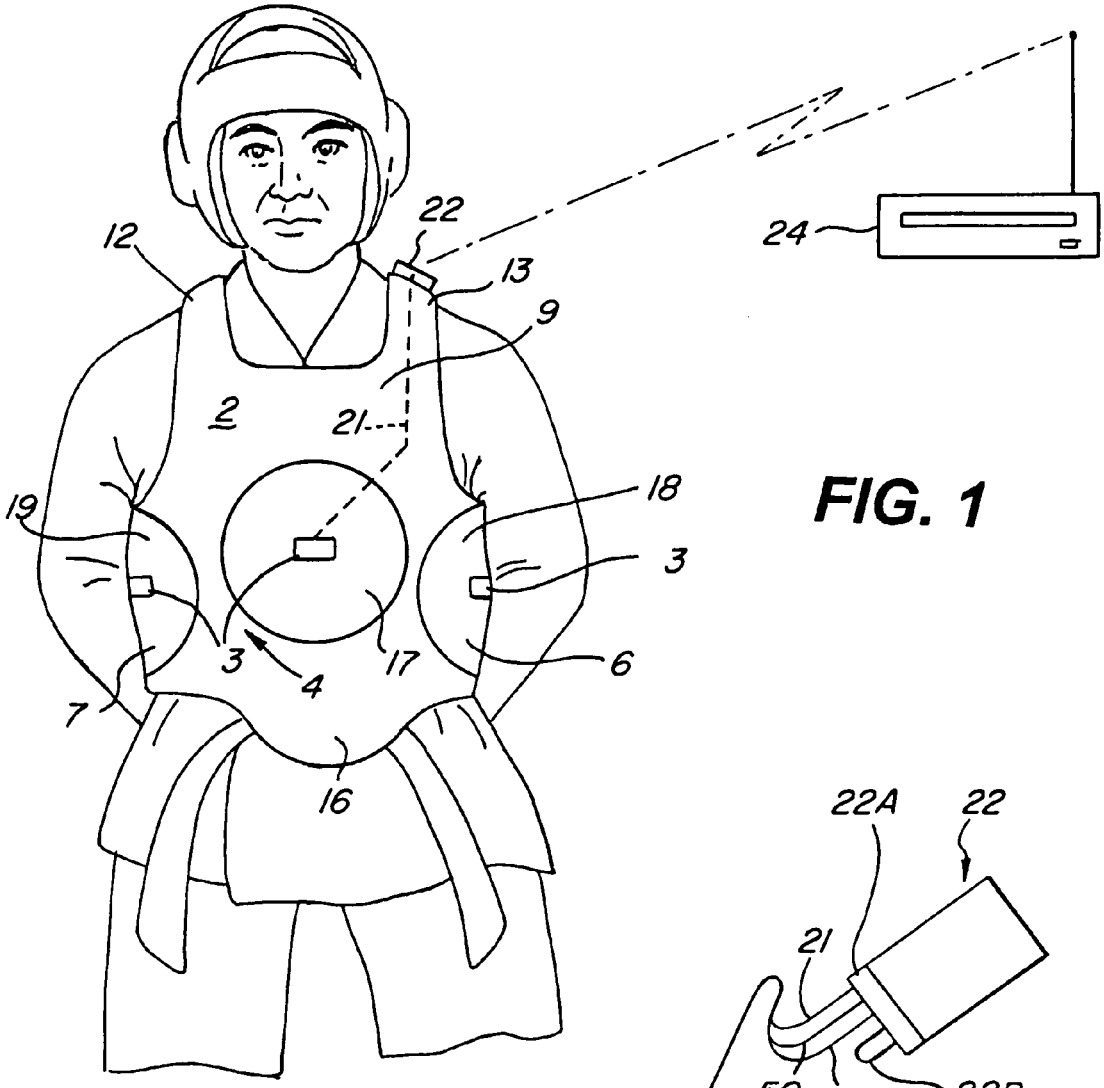
FIG. 1 is a front view illustrating the torso of a combatant equipped with a protective helmet and wearing a protective vest on which are displayed scoring locations and at which locations are embedded sensors for transmitting or conducting data to a transceiver relating to the status of an impact at those locations, which data is then transmitted to a receiver or transceiver at a control station.

The vest-like garment 2 also includes a chest portion 9 that projects laterally from the upper long edge 11 of the garment. Projecting from the chest portion 9 are shoulder straps 12 and 13 that are spaced apart sufficiently to provide a recess 14 between them to enable the garment to be tucked up under the chin of a wearer as illustrated in FIG. 1. The distal ends of the shoulder straps (not shown) may be provided with Velcro fasteners to enable removable attachment to a belt or associated ends of attachment tabs 8 behind the wearer's back.

At the lower edge of the garment, there is provided a downwardly projecting protective member 16 that coves the lower abdominal area below the umbilicus, generally between the left and right inguinal areas of the human body. Embodied in protective gear, this projection provides protection from an impact that inadvertently strikes the body below the designated target area.

FIG. 1 shows the sensor 3 situated in the center of the target area 17 comprises a circular area that is preferably distinguished from the surrounding surface of the vest by being of a different color, thus providing greater visibility and thus enhancing the likelihood that the impact from a kick will be applied to the target area. In addition to the target area 17, there are also left and right lumbar area targets 18, 19, respectively, each of which has mounted in its center a sensor element 3 similar to the one attached to the abdominal area 17.

FIG. 1 shows the sensor or force transducer 3 is connected by a set of conductors 21 to a transceiver unit 22 detachably secured to the garment 13. The set of conductors is normally threaded through the garment (and/or the protective padding) and passes in front, between or behind these garments to be attached to the transceiver. The transceiver is detachably secured in a location on or in the garment where it is not likely to be damaged due to impact. Alternatively, the transceiver could conceivably be mounted in any headgear worn by a combatant and be connected to the force transducer by a flexible lead, opposite ends of which detachably connect to the sensor and the transceiver.

Figure 2:
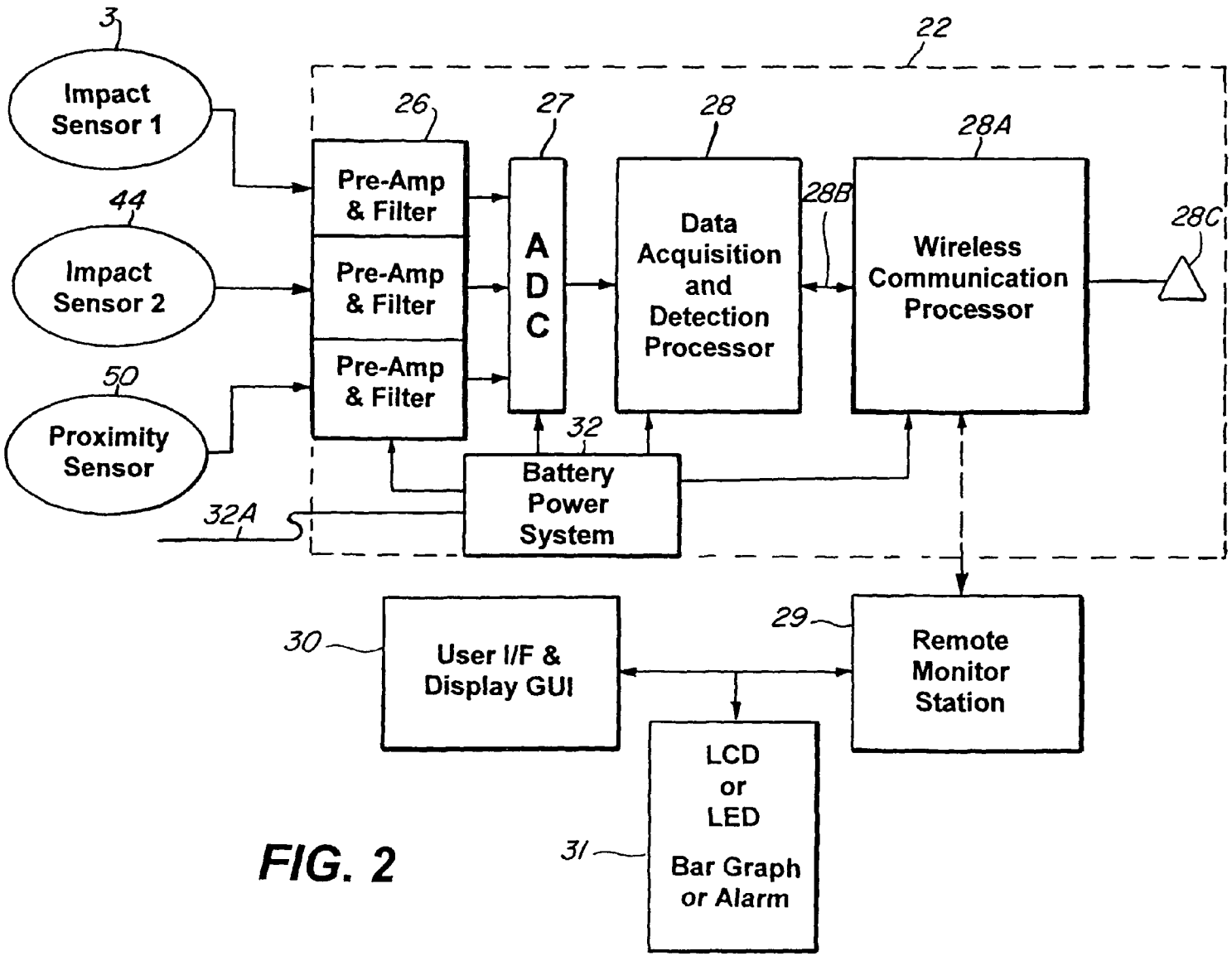
FIG. 2 is a block diagram of the signal processing apparatus.
Figure 10:
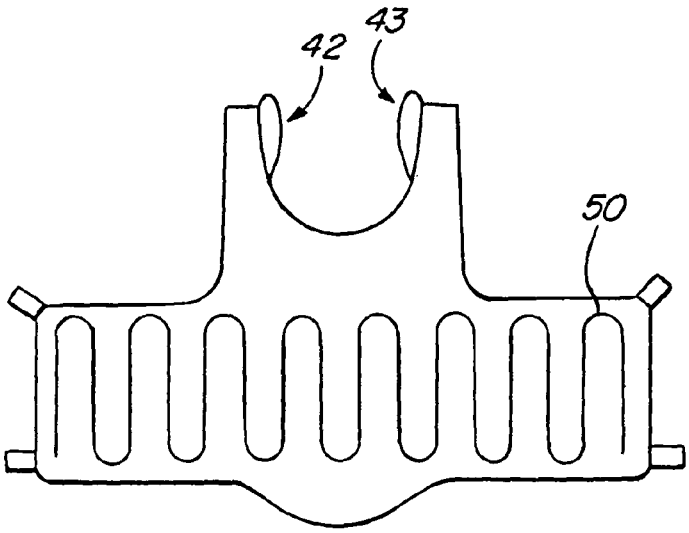
FIG. 10 is an enlarged view of the neck area that illustrates the additional padding for protection of the neck area against the abrasion from the equipment as well as extra comfort.
Figure 11:
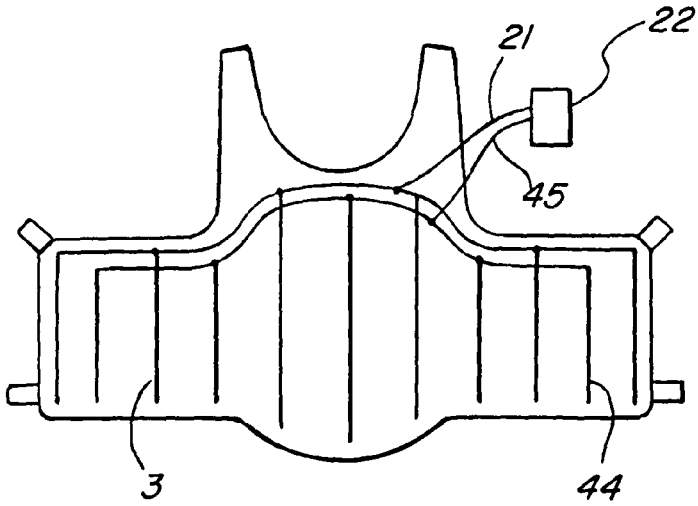
FIG. 11 is a plan view similar to FIG. 8, but illustrating yet another embodiment that allows multiple channels of sensors for detecting impact blows. Sets of sensor cables are tied to the electronics through multiple points of electrically conducting wires. Each set of sensor cables are tied to the electronics through a common electrically conducting wire representing a detection channel. Multiple channels allow for redundancy and self-detection of sensor failure. Each sensor channel is place in the garment such that it detects approximately the same impact magnitude. If one sensor channel malfunctions, then the values between the two or more channels would be significantly different enough to indicate that one of the channels has failed. Another advantage of multiple channels would be to provide more accurate sensing mechanisms through more sophisticated signal processing algorithms such as averaging, correlation, peak comparison, and time differentials in the peak.

In all the figures, the proximity sensor is implemented by overlaying electrically conductive wires into the vest garment (summary illustration in FIGS. 9 and 11). In cases where the garment can be worn with either side facing forward (a reversible garment), the identical conductive wires are embedded on both sides of the protective material. The ends of conductive wire 50 (FIG. 10) are fed into the preamp filter 26 of the sensor module 22 (FIG. 2).

Figure 12:
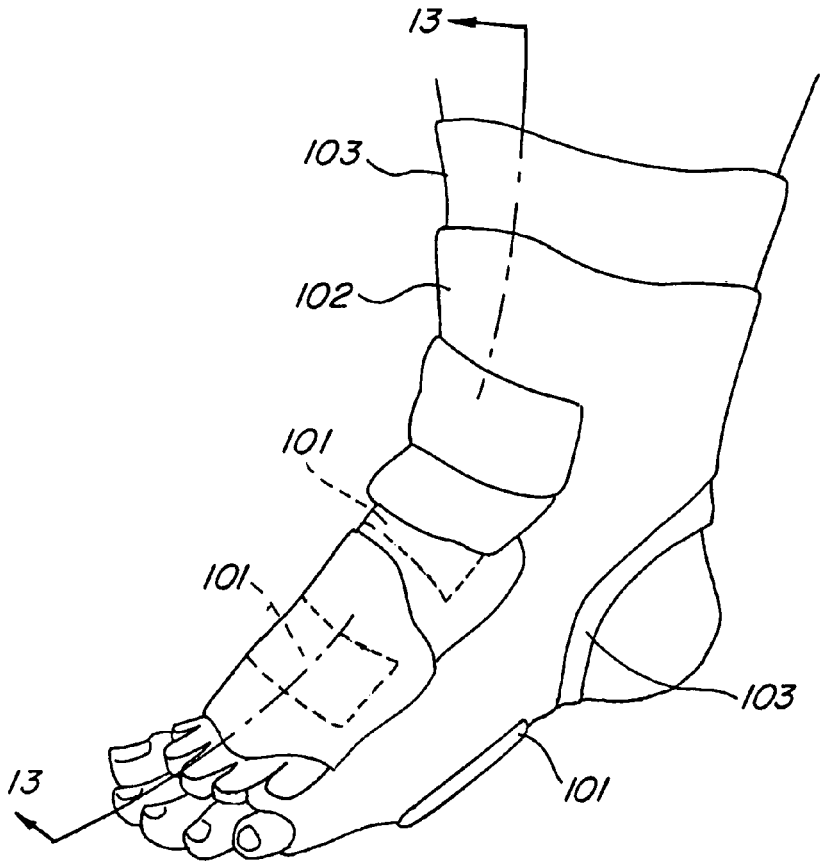
FIG. 12 is a plan view of foot gear with embedded magnets that induces a voltage signal as it approaches the garment shown in FIG. 1.
Figure 13:
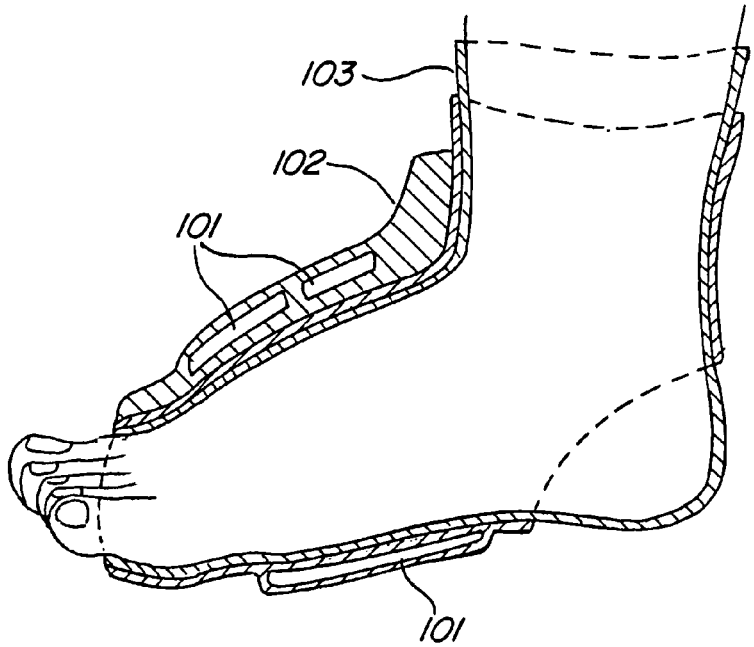

According to one aspect of the invention, an attacking player wears a specially constructed foot gear or head gear which have embedded magnets that induce a current flow in the wires. The preferred embodiment of the foot gear is shown in FIG. 12, the foot gear being shown to demonstrate compliance with competition rules where a kicking technique is the only valid scoring technique. In a similar fashion, the magnets are embedded in gloves to accommodate competition rules where hand techniques are allowed to score points.

The foot gear of FIG. 12 is typically a padded material that is formed to slip over the feet like a pair of socks. In general, foot gear refers to any form that protects the foot and at the same time incorporates the embedded magnet to trigger the proximity sensor 50 of the sensor module 22. For practicality and comfort, the foot gear Is open-toed and open-heeled. The foot gear includes an elastic material that wraps around the foot from top to bottom while the elastic material ensures tight fitting. Typically, the foot gear has a built-in padding at the top of the foot to provide protection to the players.

The magnetic materials are embedded around the foot to induce current in the opposing electrically conductive wires as the foot approaches a target. Although in this embodiment as shown, the magnet is embedded into the top and bottom of the foot gear, it could be placed anywhere in the foot gear to cause the optimum triggering of an opponent's sensor. FIG. 12 shows the magnet overlaid on top of the protective passing and at the insole at the bottom of the foot.

The elasticity of the foot gear and natural perspiration of the player causes the foot-gear to stick to the foot. This causes difficulty in wearing and removing the foot gear which is annoying and can cause a time crisis during the preparation for a competition. According to one aspect of this invention a specially designed garment is provided that a player slips of the foot before wearing the foot gear. The garment 103 shown in FIG. 12 is designed to be light, sweat-absorbing, and is positioned between the skin of the foot and the foot gear.

As an attacker player's foot with an embedded magnet approaches an opponent's target, it induces a current in the electrically conductive wire. The current sensing amplifier 26 in the sensor module 22 senses the presence of the magnet and enables the impact detection function which is processed through sensors 3, 44 and 50. Once enabled, upon receiving an impact, the impact transducers generate an electrical signal that is processed by a data acquisition and detector processor 28 and transmitted to a remote monitoring station 29 by a wireless communication processor 28A through an antenna 28C. This signal is then displayed or otherwise indicated at a display 30 or bar graph or alarm 31.

The processor 28A may be packaged in a separate enclosure or combined within a common enclosure (shown as sensor module 22). In either configuration, the wireless communication processor is connected to the radio frequency (RF) antenna 28C to transmit the processed signal to a remote monitoring station. (conducted to the transceiver which in turn conducts or transmits the signal to a signal processing apparatus 23. Such an apparatus may be as far away as 500 feet from the combatants, and preferably located in or associated with a control station or control interface 30 that provides a user with the facility to control the sensor and to set the operating parameters of the system.

In that regard, reference is made to FIG. 2 showing a signal process apparatus in block diagram form. As shown, the electrical signal generated by the sensors 3, 34 in response to an impact is correlated to the impact intensity and the signal is led to an amplifier 26 of conventional design. At the same time, the proximity sensor 50 is designed to detect the presence of a magnet embedded in the attacking player's apparatus. The typical proximity sensor consists of an electrically conducting copper wire of any convenient diameter.

Typically, a commercially available, flexible magnet is used to induce a current in the conductive material based on Lentz and Faraday laws. Both the impact sensor and the proximity sensor can either be embedded into the athlete's protective equipment or a separate garment worn over or under the existing equipment. A typical impact sensor may include a piezo film based on fiber or accelerometer, and/or a micro machined electro-mechanical system (MEMS) based accelerometer. The piezo electric film can quantitatively measure the impact over a large surface. The accelerometer measures acceleration due to an impact force over a smaller area. The piezo electric film sensor generates an electrical charge across the conducting materials when subjected to an impact, and the amount of charge generated is directly proportional to the impact magnitude. Given the capacitive property of the sensor which is proportional to the cable length, the following relation is established:

Qo=g*x*l, where Qo=the total charge generated by the sensor;

g=appropriate piezoelectric coefficient for the axis of applied stress or strain;

x=applied stress in the relevant direction; and, t=film thickness.

Given the above relationship, the output voltage can be expressed as: Vo=Qo/Cf, where Qo=the basic charge sensitivity in coulomb per psi or ergs (gravity force). This term is directly related to the parameters given in the above equation; and, Cf=internal sensor capacitance.

An accelerometer is a transducer whose electrical output is proportional to the acceleration motion of its base. Its small size, light weight and higher frequency response makes it ideal for measuring vibration and impact generated force in a small area. Typically, Vo=G*S; Vo=output voltage; G=acceleration measured in units of earth's gravity; and, S=scalar factor.

Hence, the voltage generated in the wire loop used for sensing follows Faraday's law of induction:

V=d"O"/dt, where V=voltage; and "O"=change in flux.

In short, the voltage generated in the current loop is inversely proportional to changes in magnetic flux, and in the present system, the flux change is generated by the approaching magnets embedded in the attacker's foot gear material 101 (FIG. 12). The amplifier 26 in the electronics detects this voltage and determines validity and, the magnitude of the voltage is a function of the magnet strength and mechanical layout of the wire. The amplifier is designed to detect sudden changes in voltage as a result of magnetic flux change which determines the proximity of the magnet causing this flux change; in this application, amplitude and voltage sign change is not critical to the detection function.

Upon impact, the signal from the sensors 3 and 44 are processed electronically for magnitude determination. The signal processing electronics is typically located on the athlete's protective equipment (but could be located in the remote monitoring station 29, off the athlete) where it is least likely to interfere or receive a direct impact. The data acquisition and detection processor 28 electronically conditions the signal and processes the signal to determine its magnitude. The magnitude is compared against a pre-set threshold to determine the validity of the impact for point-earning purposes or simply displayed as a graph or enerty number on a screen, monitor or TV as part of a user interface and display GUI 30. The sensor signal is forwarded to the operational amplifier, when required.

The amplifier output is converted to digital data by means of an ADC 27, and digital data acquired by the data acquisition and detection processor 28 is processed for comparison against a threshold base. When the data from the ADC is greater than a set threshold, the processor 28 prepares the data in digital form and sends it to the wireless communication processor 28A. This data information is then sent to the remote monitoring station 29 using a wireless communication protocol and commercially available frequency communication hardware. The remote monitoring station 29 constitutes a remote communication interface with a sensor module 22, and a user interface and display GUI software in the interface hardware 30 and/or display device 31 such as an LCD, LED, bar graph or audible alarm, and thus constitutes a local display interface.

Figure 1A:
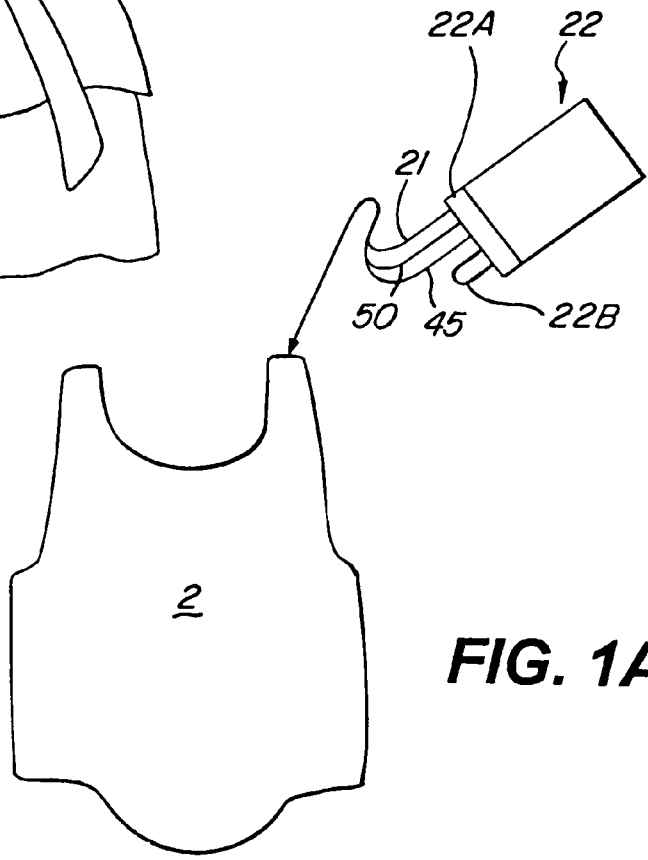

To be portable, the electronics are designed for low power consumption and are powered by a commercially available economical battery 32, and this battery supplies power to the electronics in the sensor module 22. When the sensor module is plugged into the garment 2, the battery terminal connects to the electronics in the sensor module 22 through 22B (FIG. 1A). When the sensor module is unplugged from the connector 22A, the battery terminal is disconnected from the electronics in the sensor module. Hence, the wire loop functions as the power switch which is turned on when the module is plugged into the connector and turned off when disconnected. Accordingly, the battery is not used when disconnected, and this eliminates unnecessary use of the battery.

A threshold of use is set by the user through the interface hardware 30, and allows the user to determine levels at which a valid impact can be registered. As indicated, the threshold will depend on the size and age of the user during competition, or appropriate level during training sessions. The display/user control interface provided by the local display interface 31 will display the status of the impact for observation purposes. There are at least two types of display status, namely a visible light indicating a valid score, or a display indicating the relative intensity of an impact. In the first case, an impact greater than a pre-determined criterion turns on a light indicating a valid score. In the second case, the relative impact intensity can be used using a bank of lights (a bar graph) or a numeric display. Using a bar graph, the activated (illuminated) portion of the bar is a function of impact intensity. The numeric display is typically implemented by a segmented light emitting diode (LED). An audible status indicator can also be implemented either simultaneously with or in place of the light display, and would be similar to the light display where impact intensity controls an audible volume.

The user interface 30 allows a user to set operation parameters, configure thresholds, and status signals from the sensor module 22. The remote monitoring station 29 provides a wireless link to the sensor module through the communication processor 28A. The sensor operation parameters could include threshold settings, data collection (e.g., magnitude of impact, impact time, number of impacts, etc.). The display apparatus 31 can be a larger sized light for greater visibility, an amplifier speaker, a TV, or a more sophisticated display for better entertainment value.

The signal processing electronics are packaged in a compact and rugged module which is easily attached and removable from the sensor merely by inserting the module into a "holster" or inserting a connector into the module. Power to the electronics is automatically applied when the module is inserted into the holster. A family of modules is designed to provide a variety of combinations of functions and features. For example, a lower cost module is designed to provide a simple, visible display for cost sensitive applications. An elaborate bar graph module can be designed for applications that require the ability to monitor impact magnitude. Finally, a remote monitoring module is designed for full feature integration to a control station for a variety of applications. The modular detachable design provides more versatility for different cost/performance requirements, allowing greater usage. As more functional requirements are identified, or new technology becomes available, new modules can be designed into the family incrementally with little or no affect to the existing modules or support systems. Detachability of the module allows easy access to the electronics for repair, upgrade, or data dump.

An important feature of this invention is the successful integration of the sensor to the protective equipment or gear. A large quantity of protective equipment or gear without the provisions for inclusion of a sensor mechanism already is in use by competitors in the sport of martial arts. To meet this need, the apparatus shown in FIGS. 1 AND 3-8 is provided. The sensor and electronic signal processing apparatus are embedded in a garment which is light in weight, yet rugged. The garment straps over the existing protective gear and the sensor element is patterned into the garment in the various ways illustrated in FIGS. 3-8 to cover the impacts over the legal areas.

One of the key functional elements of the sensing mechanism is the accuracy, reliability and ability to perceive sensor failure. All of these issues can be addressed by implementing multiple sensor channels, as illustrated in FIG. 11. A second sensor channel 44 is shown identical to the first channel 3. The sensor 44 is connected to the transceiver 22 through a separate conductive material 45 and processed separately from the first channel. The sensor materials are spaced such that both channels will pick up impacts with similar magnitudes. A malfunction in one of the channels can be determined when signals from the channels differ by a significant amount. The channel showing a significantly low signal level compared to the other channels can be considered to be malfunctioning.

In addition to the arrangement discussed in the previous paragraph, where the sensor and signal processing apparatus are mounted on a separate garment that is donned over the protective gear, it is contemplated that ultimately, the sensor and signal processing apparatus will be included directly into the protective gear, thus reducing overall cost and increasing reliability.

The neck guards 42, 43 in FIG. 10 provide comfort and an extra level of protection for the players and employ soft materials such as a low rebound memory foam encased in a smooth fabric. The fabric smoothness protects a player from abrasion compared to roughness of the fabrics 12, 13. In addition, the padding provided by the inner foam material provides extra protection from shock caused by a nearby impact of shifting of the vest-like garment during rapid movement of the players.

Using principles discussed herein, the sensors can be embedded into the practice targets used for kick boxing training, such as punching bags, kick paddles and other equipment other than an opponent, for developing new kick boxing techniques and methods for monitoring training progress. Again, piezo electronic film based sensors are applied to the practice and training targets so as to cover a large area to measure the intensity of a kick while an accelerometer is used for smaller and more compact targets typically used for speed and accuracy of measurement. Similar display and control mechanisms can be used in such applications.

Using principles discussed herein, the sensors can be embedded into simulated weapons such as swords and sticks for training in martial arts that involve weapon competition. The weapons with embedded sensors can detect the impact and proximity of other opponent's weapons to determine the validity of a technique.

To maintain the accuracy of a signal generated by a sensor, despite the fact that signal variations are minimal within a sensor type and a fixed overall geometry, there may be a minute variation in the sensor sensitivity due to differences in component tolerances and manufacturing procedures. This variation may cause inconsistencies in measurements leading to scoring inaccuracy. These signal variations may be addressed and eliminated by periodic calibration of the sensor and adjustment of the electronics to compensate for such variations. Calibration can be performed using various conventional methods which rely on the basic principle of measuring the difference between a known reference impact generated signal and an impact generated signal measured by the sensor. This amount is used to adjust the sensor output mathematically to produce an accurate measure of an impact. Typically, calibration is performed using a stand alone calibration apparatus which uses a known weight dropped on a sensor from a pre-determined height. Upon impact, the sensor measures the magnitude of impact and compares it against the expected mathematically determined impact to calculate any discrepancy. This discrepancy is used to adjust further measurements by the sensor during normal operation.

The invention claimed is:

1. An article of equipment incorporating a detection system for monitoring and registering the intensity and location of impacts for players in contact sports, comprising:

(a) at least one electrically conductive wire providing a proximity sensor function, the wire embedded as a mechanical layout in the equipment;

(b) an impact sensor connected to the conductive wire and embedded in the equipment, the impact sensor being adapted to generate an electrical signal based on the impact and location of an impact, wherein the impact sensor is an accelerometer;

(c) a magnet mounted in an attacking gear of the player, the proximity sensor being adapted to detect the approaching presence of the magnet and to generate an electrical impulse proportional to the intensity and location of a subsequent impact;

(d) a transceiver connected to the conductive wire;

(e) a signal processor connected to the transceiver, whereby changes in voltage as a result of changes in voltage due to changes in magnetic flux caused by proximity of the magnet to the impact sensor will determine the extent of impact and the location of an impact based on the mechanical layout of the embedded wire in the equipment; and, (f) an output signal from the signal processor, the output signal defines sufficient information to produce at least a visual display and/or an audible signal.

2. The article of equipment of claim 1, in which equipment comprises an article of clothing and the impact sensor is both the accelerometer and a piezoelectric device.

3. The article of equipment of claim 1, in which the equipment comprises simulated weapons and practice targets and the impact sensor is the accelerometer and a piezoelectric device.

4. The article of equipment of claim 1, in which the output signal defines sufficient information to produce a bar graph, the audible signal, at least one blinking lights, at least one display status and a numerical display.

5. The article of equipment claim 1, in which a battery driven sensor module is plugged into the conductive wire in the equipment, the battery terminal connecting to the signal processor, and when the sensor module is unplugged from the equipment, the conductive wire functions as a power switch to turn off the signal processor, thereby saving battery power.

6. The article of equipment of claim 1, in which the equipment is an article of clothing overlaid by a lightweight layer of protective clothing.

7. The article of equipment of claim 1, in which the output signal is fed through multiple sensor channels to the signal processor.

8. An electronic system for registering the intensity and location of contact in a monitoring device, comprising:

(a) a plurality of electrically conductive wires providing a proximity sensor function, the wires are embedded within and arranged as a mechanical layout in a piece of contact sporting equipment;

(b) an impact sensor associated with the equipment, adapted to generate an electrical signal based on an impact and a location of the impact;

(c) a magnet mounted on the equipment, the proximity sensor being adapted to detect an approaching movement of the magnet and to generate an electrical impulse proportional to an intensity and location of the subsequent impact;

(d) a transceiver connected to the electrically conductive wires;

(e) a signal processor connected to the transceiver, whereby changes in voltage as a result of changes in voltage due to changes in magnetic flux caused by proximity of the magnet to the impact sensor will determine the extent of location of an impact based on the mechanical layout of the conductive wire; and (f) an output signal from the signal processor, the output signal defines sufficient information to produce at least a visual display and/or an audible signal.

9. The electronic system claim 1, in which the output signal is fed through multiple sensor channels to the signal processor.

10. The electronic system of claim 8, in which the impact sensor is one or both of an accelerometer, or a piezoelectric device.

11. The electronic system of claim 8, in which the output signal defines sufficient information to produce a bar graph, the audible signal, at least one blinking lights, at least one display status and a numerical display.

12. The electronic system of claim 8, in which a battery driven sensor module is plugged into the conductive wires, the battery terminal being connected to the signal processing, and when the sensor module is unplugged, the electrically conductive wires function as a power switch, to disconnect the battery from the signal processor, thereby saving power.

13. An article of equipment incorporating a detection system for monitoring and registering the intensity and location of impacts for players in contact sports, comprising:

(a) a plurality of electrically conductive wires providing a proximity sensor function, wherein the wires are all embedded as a mesh within the article of equipment;

(b) an impact sensor connected to the conductive wire and embedded in the equipment, the impact sensor being adapted to generate an electrical signal based on the impact and location of an impact, wherein the impact sensor is a piezoelectric device;

(c) a magnet mounted in an attacking gear of the player, the proximity sensor being adapted to detect the approaching presence of the magnet and to generate an electrical impulse proportional to the intensity and location of a subsequent impact;

(d) a transceiver connected to the conductive wire;

(e) a signal processor connected to the transceiver, whereby changes in voltage as a result of changes in voltage due to changes in magnetic flux caused by proximity of the magnet to the impact sensor will determine the extent of impact and the location of an impact based on the mechanical layout of the embedded wire in the equipment; and, (f) an output signal from the signal processor, the output signal defines sufficient information to produce at least a visual display and an audible signal.

14. The article of equipment of claim 13, in which equipment comprises an article of clothing and the impact sensor is both an accelerometer and the piezoelectric device.

15. The article of equipment of claim 13, in which the equipment comprises simulated weapons and practice targets and the impact sensor is both an accelerometer and the piezoelectric device.

* * * * *